United States Patent [19]

Trop

[11] 4,454,010

[45] Jun. 12, 1984

[54] PALLADIUM PLATING PROCEDURE

[75] Inventor: Harvey S. Trop, Morris Plains, N.J.

[73] Assignee: AT & T Bell Laboratories, Murray Hill, N.J.

[21] Appl. No.: 412,512

[22] Filed: Aug. 30, 1982

[51] Int. Cl.[3] ..... C25D 3/52
[52] U.S. Cl. ..... 204/47
[58] Field of Search ..... 204/47, 43 N; 260/429 R

[56] References Cited

U.S. PATENT DOCUMENTS 4,153,523 5/1979 Koontz et al. ..... 204/15
4,278,514 7/1981 Morrissey ..... 204/47

OTHER PUBLICATIONS

Cleare, M. J. et al., Inorganic Chem., vol. 2, pp. 207–208, (1973).

*Primary Examiner*—G. L. Kaplan
*Attorney, Agent, or Firm*—Walter G. Nilsen

[57] ABSTRACT

A palladium electroplating process is described in which a unique compound is used to supply palladium to the electroplating bath. The procedure is particularly useful where a polyamine such as 1,3-diaminopropane is used as the complexing agent for palladium in a palladium electroplating bath. The unique compound is palladium-1,3-diaminopropanedichloride which is highly stable, can be made in pure form, and is readily soluble in water, aqueous solutions, and typical palladium baths.

22 Claims, 1 Drawing Figure

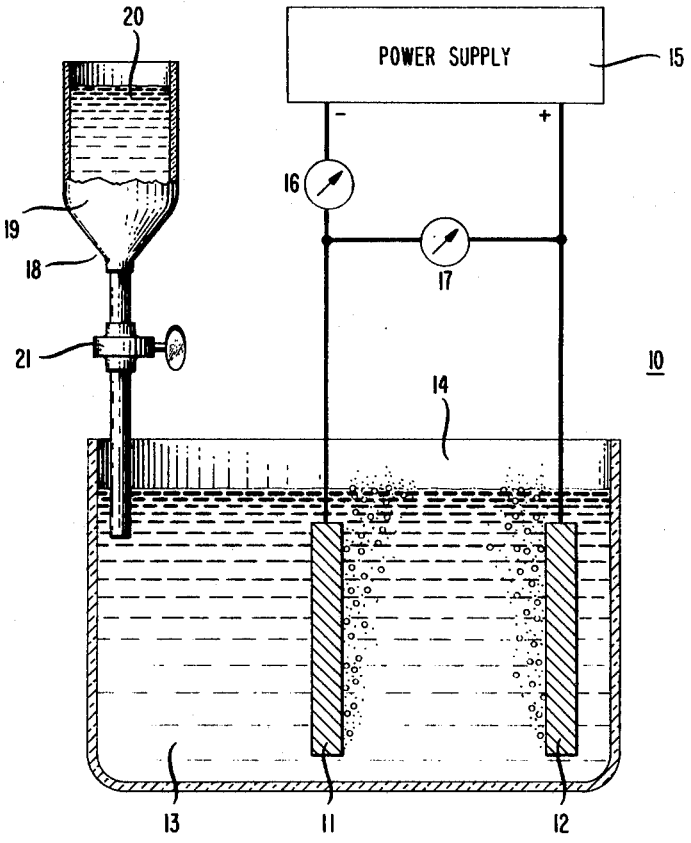
POWER SUPPLY
15
20
19
18
21
16
17
10
14
13
11
12
-
+

PALLADIUM PLATING PROCEDURE

TECHNICAL FIELD

The invention involves a palladium electroplating process. In particular, it involves a procedure for making a palladium bath and replenishing palladium in the bath.

BACKGROUND OF THE INVENTION

Precious metals are used in a variety of industrial applications including in electrical circuits as electrical contact surfaces, conducting paths and heat sinks. Various properties of precious metals make such applications highly advantageous. These properties include physical and chemical stability, high electrical conductivity and high thermal conductivity. Precious metals are often used in high-density circuits such as integrated circuits because of one or more of the properties set forth above. Gold is used extensively in these applications with great success. However, the high price of gold and the rapid fluctuations in the price of gold makes it attractive to consider other precious metals for some of the applications where gold is traditionally used.

For many of the applications outlined above, palladium and palladium alloys may be highly useful. Because of chemical inertness, reasonable hardness and good wear characteristics, palladium is especially attractive as an electrical contact material in electrical connectors, relay contacts, switches, etc. Various palladium alloys such as palladium-silver, palladium-nickel, and palladium-copper are also useful for the same applications. Indeed, because of the increasing cost of gold, palladium and palladium alloys become more and more attractive economically as a contact material, surface material and in other applications.

A particularly difficult problem in palladium electroplating processes is selection of a suitable palladium compound to supply palladium initially to the bath and replenish the bath as palladium is used up. The compound should be stable, easily made in reasonably pure form and readily soluble in the electroplating bath. The problem is particularly difficult where rapid, high quantity palladium electroplating is being carried out. In this case, relatively large amounts of palladium metal are being plated out and therefore large amounts of palladium must be added to the bath. Under these circumstances, high solubility and high rate of solubility is extremely important. In addition, compatibility of the components of the palladium compound (complexing species, anion, etc.) is also of much practical importance since it might limit the lifetime of the electroplating bath and alter the electroplating characteristics of the bath.

A variety of procedures have been used to electroplate palladium, including the use of various aliphatic polyamine compounds as complexing agents in the electroplating process.

SUMMARY OF THE INVENTION

The invention is a palladium (or palladium alloy) electroplating process in which at least part of the palladium in the electroplating solution is supplied as palladium-1,3-diaminopropanedichloride $Pd(pn)Cl_2$. In this formula, pn denotes 1,3-diaminopropane. It is believed that palladium-1,3-diaminopropanedichloride is a new compound and that methods of preparing this compound from a variety of starting materials including $PdCl_2$ and $Pd(NH_3)_2Cl_2$ are new. This source of palladium may be used with a large variety of palladium baths, but is particularly useful where 1,3-diaminopropane is used as the complexing agent for palladium in the electroplating bath. This procedure is advantageous because of the ease of making $Pd(pn)Cl_2$ in pure form (so that the amount of palladium in the compound is reliably known), the stability of the compound, and the rapid and high solubility of the compound in palladium baths.

BRIEF DESCRIPTION OF THE DRAWING

The FIGURE shows a typical electroplating apparatus including replenishment means.

DETAILED DESCRIPTION

In broad terms, the invention is based on the discovery that a certain palladium compound, believed to be a new compound, is an ideal substance for supplying palladium to a palladium plating bath. This compound is palladium-1,3-diaminopropanedichloride. It may be used to make up the bath or replenish the bath. It may be added in the form of a solid, concentrated solution or more dilute solution where this is convenient. This compound has many advantages as a replenishment agent. First, it can be made easily in pure form from readily available palladium compounds. Second, it is stable and can be stored over long periods of time without decomposition or deterioration. Third, it is rapidly soluble so that it can be added as a solid to a palladium bath. It has high solubility so that it can be supplied in the form of a concentrated solution. Also, since only one complexing molecule is present in the palladium compound ($Pd(pn)Cl_2$), accumulation of 1,3-diaminopropane is slower than with other sources of palladium.

A variety of bath chemistries may be used in the practice of the invention. Generally, the bath should contain a source of palladium and be sufficiently conducting to permit reasonable electroplating rates (at least $10^{-3}$ mho-cm). Typical are ammonia-based plating solutions often with palladium complexed with ammonia, but other types of palladium plating solutions are also useful. Some typical solutions with preferred composition ranges are given below.

(1)

$Pd(NH_3)_4Cl_2$
$NH_4Cl$
Sufficient ammonia to a pH of 9–10, 9.4 most preferred.

The amount of palladium salt should be at least 10 gm/l in terms of palladium metal. Higher concentrations are often preferred, say at least 20 gm/l or even 100 gm/l.

(2)

$Pd(NH_3)_2(NO_2)_2$: 4 g Pd/l
$NH_4NO_3$ (optional): 90 gm/l
$NaNO_2$ (optional): 11.3 gm/l
Ammonia to pH between 8 and 10, with 9.0 most preferred.

(3)

$Pd(NH_3)_4(NO_3)_2$
Salts to stabilize the complex and increase conductivity.
pH=7–10 by the addition of alkaline agent such as ammonia.

(4)

$Pd(NH_3)_2Cl_2$: 10 gm/l to saturation
$NH_4Cl$: 65 to 250 gm/l
pH adjusted by the addition of ammonia to 8.0–9.2 with 8.8 most preferred.

For many applications, a high concentration of the palladium salt is preferred with or without the conducting salts, provided such a bath is stable.

Other palladium complexes are also useful as plating baths in the practice of the invention. The palladium complex $Pd(NH_3)_4Br_2$ is used as the basis for some palladium plating baths. Useful concentrations in terms of palladium metal are from 2 g/l to saturation (about 35 g/l). The pH range is from 9 to 10 with the range from 9 to 9.5 preferred. Other palladium complexes such as the corresponding sulfate, phosphate, tartrate, citrate, oxalate and carbonate also may be useful.

The double nitrite salts of palladium are also useful for palladium plating. A typical salt is $K_2Pd(NO_2)_4.2H_2O$. Other similar salts (i.e., potassium replaced by another alkali metal such as sodium, lithium, etc.) may also be used.

Another typical palladium bath contains a palladium solution complexed with ethylenediamine or other complexing agent. Typically, the palladium is added as $PdCl_2$ and sulfate as an alkali-metal sulfate ($Na_2SO_4$). Sufficient complexing agent (i.e., ethylenediamine) is added to dissolve the palladium chloride. Typical concentrations are 28 g/l $PdCl_2$ and 140 g/l $Na_2SO_4$. Increased concentration of palladium compound is desirable up to the saturation concentration of the palladium complex. The pH may vary over wide limits (i.e., 10–13) but is usually between 11 and 12.

The simple salt $PdCl_2$ is also useful in plating baths in the practice of the invention. Typically, the bath comprises $PdCl_2$, ammonium chloride and a strong acid (generally aqueous HCl) to a pH from 0.1 to 0.5. Typical concentration of $PdCl_2$ is 52 g/l to saturation and 22–38 g/l $NH_4Cl$. Plating temperature to 50 degrees C is usually used.

Although the source of palladium described above may be used with a great variety of palladium electroplating baths, it is most useful when used with a bath where palladium is complexed with an aliphatic polyamine. Particularly advantageous is an aliphatic polyamine with 3–20 carbon atoms, especially aliphatic diamines with 3–10 carbon atoms. These baths are most preferred because of the excellent plating results obtained and compatibility with the palladium source palladium-1,3-diaminopropanedichloride. More than one aliphatic polyamine may be used in the bath. Typical complexing agents are diaminopropane (particularly 1,3-diaminopropane), diethylenetriamine, 1,4-diaminobutane, 1,6-diaminohexane, etc. Secondary polyamines such as N,N'dimethyl-1,3-propanediamine and tertiary polyamines such as N,N,N',N'tetramethylethylenediamine are also useful provided the total number of carbon atoms does not exceed 20. A limited number of substituents are also useful, such as hydroxy groups (i.e., 2-hydroxy-1,3-diaminopropane) and halogen groups such as chloride and bromide. The complexing agent 1,3-diaminopropane is most preferred because of excellent plating results especially at high current rates and also compatibility with the palladium compound, palladium-1,3-diaminopropanedichloride. It is preferred that the aqueous electroplating bath be alkaline (pH greater than 7.0) to avoid corrosion of the surface being plated and sufficiently conductive to allow plating (generally greater than $10^{-3}$ mho-cm). Additional substances may be added to the palladium plating bath to control and adjust pH (such as a buffer), to increase conductivity and to improve the properties of the plated metal. Typical substances used to improve the plated metal are lactones (i.e., phenolphthalein, phenolsulfonephthalein, etc.), lactams, cyclic sulfate esters, cyclic imides and cyclic oxazolines. Certain polyalkoxylated alkylphenols may also be useful. The process is also useful for plating certain palladium alloys including 10 mole percent palladium, remainder copper, nickel and/or silver.

There are a number of advantages associated with use of organic aliphatic polyamines as complexing agent in palladium electroplating processes. First, the conditions (particularly pH, corrosivity) are much improved so that chemical attack on the surface being plated is much reduced or eliminated. Second, production of hydrogen is eliminated even at high plating rates (even above 200 or even 500 ASF). Third, the quality of plating is much improved even at very high plating rates. The pH of the bath may vary over large limits, but generally alkaline aqueous solution is preferred (typically pH from 7.5 to 13.5) with the range from 11.0 to 12.5 preferred. The preference particularly applies when the preferred polyamines are used, namely organic aliphatic diamines with 3 to 10 carbon atoms and most particularly 1,3-diaminopropane. Within the pH range, very rapid plating can be carried out with excellent plating results. Generally, a bath composition which permits rapid plating with more alkaline solution is preferred because of decreased attack on the surface being plated and decreased chances of hydrogen evolution.

The plating process may be carried out with or without a buffer system. A buffer system is often preferred because it maintains constant pH and adds to the conductivity of the bath. Typical buffer systems are the phosphate system, borax, bicarbonate, etc. Preferred is the $HPO_4^{-2}/PO_4^{-3}$ system often made by adding an alkali-metal hydroxide (KOH, NaOH, etc.) to an aqueous solution of the hydrogen phosphate ion. Generally, the concentration of buffer varies from about 0.1 molar to 2 molar (about 1.0±0.2 molar preferred) and the mole ratio of hydrogen phosphate to phosphate varies from 5/1 to 1/5 (with equal mole amounts within ±50 percent preferred). These mole ratios often depend on the particular pH desired for the plating bath.

The bath temperature may vary over large limits, typically from the freezing point to the boiling point of the electroplating bath. Often, the preferred plating temperature range depends on bath composition and concentration, plating cell design, pH and plating rate, Preferred temperatures for typical conditions are from room temperature to about 80 degrees C. with 40 to 60 degrees C. most preferred.

Various surfaces may be plated using the disclosed process. Usually, the plating would be carried out on a metal surface or alloy surface, but any conducting surface would appear sufficient. Also, electrolessly plated surfaces may be useful. Typical metal and alloy surfaces are copper, nickel, gold, platinum, palladium (as, for example, a surface electrolessly plated with palladium and then electroplated with palladium in accordance with the invention). Various alloy surfaces may also be used such as copper-nickel-tin alloys, other copper alloys such as beryllium-copper, etc.

The composition of the bath may vary over large limits provided it contains a source of palladium and significant amounts of one or more polyamines of the class set forth above. In general, sufficient polyamine should be present to complex with the palladium. Usually, it is advantageous if excess polyamine is present in the bath solution.

The palladium concentration in the bath typically varies from 0.01 molar to saturation. Preferred concentrations often depend on plating rate, cell geometry, agitation, etc. Typical preferred palladium concentration ranges for high-speed plating (50 to 1000 ASF) are higher than for low-speed plating (up to 50 ASF). Preferred palladium concentration ranges for high-speed plating vary from 0.1 to 1.0 molar. For low-speed plating, the preferred range is from 0.05 to 0.2 molar. Where palladium alloy plating is included, the alloy metal (usually copper, silver or nickel) replaces part of the palladium in the composition of the plating bath. Typically, up to 90 mole percent of palladium may be replaced by alloy metal.

The amount of complexing agent (polyamine) may vary over large limits, typically from 0.5 times (on the basis of moles) the concentration of the palladium species to saturation of the complexing agent. Generally, it is preferred to have excess complexing agent, typically from two times to twelve times the mole concentration of the palladium species. Most preferred is about six times the sole concentration of palladium. The preferred ranges of complexing agent in terms of palladium species are the same for high-speed and low-speed baths.

The concentration of buffer may vary over large limits. Such concentrations often depend on cell design, plating rates, etc. Typically, the buffer concentration varies from 0.1 molar to saturation with from 0.2 to 2.0 molar preferred.

The bath may be prepared in a variety of ways well known in the art. A typical preparation procedure which yields excellent result in set forth below:

Equal volumes (142 mls) of 1,3-diaminopropane and water are mixed in a beaker. Heat of solution is sufficient to heat the resulting solution to about 60 degrees C. To this solution with vigorous stirring are added 50 gms of $PdCl_2$ in portions of 0.5 gms every two minutes. Since the resulting reaction is exothermic, the solution can be maintained at 60 degress C. by adjusting the rate of addition of $PdCl_2$. The solution is filtered to remove solid matter (generally undissolved $PdCl_2$ or PdO) and diluted to one liter.

To this solution are added 127 gms of $K_3PO_4$ and 70 gms of $K_2HPO_4$. The pH is 12.3 at 25 degrees C. and can be adjusted upward by the addition of KOH and downward by the addition of $H_3PO_4$.

Electroplating experiments are carried out in an electroplating cell provided with means for high agitation. Temperature is maintained between 50 and 65 degrees C., 55 degrees preferred. Current is passed through anode, electroplating bath and cathode. The electrical energy is supplied by a conventional power supply. The current density is 175 ASF. Typical thicknesses in these experiments are 40 to 150 microinches. The deposit is crack free as determined by a scanning electron micrograph at 10,000 magnification. Both adherence and ductility are excellent. Similar results are obtained using 0.1 molar palladium and 0.5 molar palladium. Plating rate is often determined by the thickness desired after a predetermined period of plating. For example, in a strip line plating apparatus (see, for example, U.S. Pat. No. 4,153,523 issued to D. E. Koontz and D. R. Turner on Oct. 28, 1980) the strip line being plated is exposed to the plating solution for a set period of time (depending on the speed the strip is moving down the line and the length of the plating cell) and the plating rate is adjusted to give the desired thickness in this period of time. Similar results are obtained with diethylenetriamine. Experiments carried out with 2 hydroxypropanediamine, 1,4-diaminobutane, 1,5-diaminopentane and 1,6-diaminohexane yield similar results.

Similar results are obtained with low-speed baths. Here the preparation procedure is exactly the same except the quantity of reagents are different. A typical bath contains 16.66 gms $PdCl_2$, 42 gms polyamine complexing agent, 42 gms $K_3PO_4$, 139 gms $K_2HPO_4$ and sufficient water to make one liter. The preparation procedure is exactly the same as above. The pH is about 10.8 at 55 degrees C. and plating is carried out in the temperature range from 50 to 65 degrees C. Typical slow plating rates are about 10 ASF.

Palladium-1,3-diaminopropanedichloride can be synthesized from a variety of starting materials. The compound $PdCl_2$ is inexpensive and readily available. Also, other palladium compounds can easily be made into palladium dichloride by well-known procedures. For example, palladium metal can be converted to $PdCl_2$ by dissolution in aqua regia, followed by digestion in concentration HCl. Also, $PdCl_2$ can be obtained by roasting palladium metal in gaseous chlorine.

Two procedures are available for converting palladium chloride into palladium-1,3-diaminopropanedichloride. In one procedure, palladium chloride and excess 1,3-diaminopropane are mixed together in water to form a solution of $Pd(pn)_2^{2+}$ ions. Acidification of this solution yields a yellow-orange solid of palladium-1,3-diaminopropanedichloride.

A specific example of this synthetic procedure is as follows:

To a solution of 600 ml (9.16 mol) 1,3-diaminopropane in 900 ml $H_2O$ is added 500 g (2.82 mol) of $PdCl_2$. After the reaction is complete, the resulting solution is treated with one liter concentrated HCl to yield yellow-yellow orange crystals of $Pd(pn)Cl_2$, 663 g yield.

Another procedure is also useful in the preparation of palladium-1,3-diaminopropanedichloride from palladium dichloride. This procedure has the economic advantage of using less 1,3-diaminopropane. In this procedure, palladium dichloride is converted to tetrachloropalladium(II) ion by the addition of chloride ion (usually by the rapid addition of an alkali-metal chloride such as sodium chloride). Approximately one equivalent of 1,3-diaminopropane is then added to form the palladium-1,3-diaminopropanedichloride. To insure complete conversion to the palladium-1,3-diaminopropanedichloride, the solution may be refluxed for a moderate amount of time (e.g., 5 minutes to 5 hours). The solid dichloride formed is typically separated by filtration.

A particular example of this synthetic procedure is as follows:

A solution containing 500 g (2.82 mol) $PdCl_2$ and 330 g (5.64 mol) NaCl in 31 $H_2O$ is treated with 237 ml (2.83 mol) 1,3-diaminopropane. This yields a solid with empirical formula $Pd(pn)Cl_2$; yield 702.0 g.

A suspension of 15.0 g $[Pd(pn)_2]$ $[PdCl_4]$ in water was refluxed for 2 hours to yield 14.9 g of crystalline solid of molecular formula $Pd(pn)Cl_2$.

Another potentially useful starting material for the production of palladium-1,3-diaminopropanedichloride is palladiumdiaminodichloride ($Pd(NH_3)_2Cl_2$). In the recovery and refining of palladium metal, $Pd(NH_3)_2Cl_2$ is often formed. For example, palladium metal is recovered from scrap metal by dissolution in aqua regia. Since base metals are often present in the resulting solution, the palladium metal is precipitated out as $Pd(NH_3)_2Cl_2$ by the addition of ammonia to the aqueous acid solution. Also, palladium is often supplied commercially in the form of this compound.

The synthesis involves mixing approximately equal molar amounts of $Pd(NH_3)_2Cl_2$ and 1,3-diaminopropane in aqueous solution to produce a mixed complex believed to be $[Pd(pn)(NH_3)_2]$. This solution is then acidified with approximately two equivalents of acid to form the palladium-1,3-diaminopropanedichloride. Although the solid may be separated immediately, allowing the solution to stand from 1 hour to 24 hours insures more complete conversion to the palladium-1,3-diaminopropanedichloride. A specific example of this procedure is as follows:

A slurry of 2.50 g ($1.18\times10^{-2}$ mol) $Pd(NH_3)_2Cl_2$ in water is treated with 1.0 ml ($1.19\times10^{-2}$ mol) 1,3-diaminopropane to yield a clear solution. The solution is treated with 2.0 ml concentrated HCl to yield a mixture of $Pd(pn)Cl_2$ and $Pd(NH_3)_2Cl_2$.

Another procedure for converting $Pd(NH_3)_2Cl_2$ to $Pd(pn)Cl_2$ is as follows:

Palladiumdiaminodichloride is reacted with approximately two equivalents of 1,3-diaminopropane in an aqueous solution with moderate heating (40 to 90 degrees C. for 10 minutes to 3 hours) to form the $Pd(pn)_2$ ion in solution. This solution is acidified (typically with two equivalents of acid) to yield the palladium-1,3-diaminopropanedichloride. The solid may be isolated typically by filtration. A specific example of the synthesis is as follows:

A slurry of 74.8 g (0.35 mol) $Pd(NH_3)_2Cl_2$ in water is treated with 59.3 ml (0.70 mol) 1,3-diaminopropane. The mixture is heated to 80 degrees C. for 1.5 hours, then treated with 62 ml (0.74 mol) concentrated HCl to yield 88.8 g $Pd(pn)Cl_2$.

Palladium-1,3-diaminopropanedichloride is a stable, yellow to yellow-orange crystalline solid which is only sparingly soluble in water at 20 degrees C. However, in solutions with excess 1,3-diaminopropane (as in the case with palladium electroplating baths), palladium-1,3-diaminopropanedichloride dissolves rapidly presumably because of the formation of $Pd(pn)_2^{2+}$ ion. The $Pd(pn)Cl_2$ is thermally stable and shows no observable change in color or reactivity on being stored at 110 degrees C. for eight weeks. The compound is easy to store and does not attack glass, plastic or paper containers. It is not hazardous to handle. Because of these properties, its rapid and high solubility, palladium-1,3-diaminopropanedichloride is an excellent source of palladium for palladium electroplating baths where aliphatic polyamines are used as complexing agents for the palladium. The palladium-1,3-diaminopropanedichloride may be used to originally charge the bath with palladium or as a replenishment agent to replace palladium already plated out. It may be introduced into the bath in the form of a solid or concentrated solution. To form a concentrated solution, some 1,3-diaminopropane is often added to increase solubility of the palladium-1,3-diaminopropanedichloride.

An example of making up the bath using palladium-1,3-diaminopropanedichloride is as follows:

To a 4001 solution of IM $K_2HPO_4$, 12.61 (152 mol) 1,3-diaminopropane is added. With stirring, 9.45 kg (36 mol) $Pd(pn)Cl_2$ is then added. A clear yellow solution containing 10 g/l Pd by atomic absorption spectroscopy is formed.

Replenishment of a palladium bath is carried out as follows:

A large Pd plating bath whose metal content was dropped from 10 g/l Pd to 8.7 g/l Pd is replenished by the addition of 3.07 g $Pd(pn)Cl_2$ per liter of plating solution. The replenished solution is found to have a Pd metal content of 10 g/l.

FIG. 1 shows apparatus 10 useful in the practice of the invention. The surface to be plated 11 is made of the cathode in the electrolytic process. The anode 12 is conveniently made of platinized titanium or may be made of various other materials such as oxides of platinum group metals, binder metal oxides, etc. Both anode and cathode are partially immersed in the electroplating bath 13 containing source of palladium complex with an organic aliphatic polyamine. A container 14 is used to hold the palladium plating solution and the anode 12 and cathode 11 are electrically connected to source of electrical energy 15. An ammeter 16 and voltmeter 17 are used to monitor current and voltage. The voltage and current are controlled inside the source of electrical energy 15. Palladium is replenished by adding palladium-1,3-diaminopropanedichloride either as a solid or concentrated solution. An apparatus 18 for doing this replenishment is also shown. This apparatus is made up of storage container 19 containing concentrated solution 20 and means 21 for controlling the flow of concentrated solution 20 into the palladium electroplating bath 13.

What is claimed is:

1. A process for electroplating a metallic substance on a surface, said metallic substance comprising palladium, comprising the step of passing current through a cathode, an electroplating bath and an anode with a cathode potential great enough to electroplate palladium, said electroplating bath having a pH between 7.5 and 13.5, a conductivity greater than $10^{-3}$ mho-cm and said electroplating bath comprising a source of palladium characterized in that at least part of the source of palladium is added as palladium-1,3-diaminopropanedichloride.

2. The process of claim 1 in which the palladium-1,3-diaminopropanedichloride is added as a solid.

3. The process of claim 1 in which the palladium-1,3-diaminopropanedichloride is added as a solution.

4. The process of claim 1 in which the electroplating bath comprises palladium complexed with ammonia.

5. The process of claim 1 in which the electroplating bath comprises palladium complexed with at least one aliphatic polyamine with 3–20 carbon atoms.

6. The process of claim 5 in which the palladium is complexed with at least one aliphatic diamine with 3–10 carbon atoms.

7. The process of claim 6 in which the palladium is complexed with 1,3-diaminopropane.

8. The process of claim 5 in which the concentration of palladium is between 0.01 molar and saturation.

9. The process of claim 8 in which the concentration of palladium is between 0.05 and 1.0 molar.

10. The process of claim 8 in which the concentration of aliphatic polyamine is between 0.5 times the molar concentration of palladium to the saturation of aliphatic polyamine.

11. The process of claim 10 in which the molar concentration of aliphatic polyamine is between 2 and 12 times the mole concentration of palladium.

12. The process of claim 1 in which the temperature of the electroplating bath is between 40 and 60 degrees C.

13. The process of claim 1 in which the pH of the electroplating solution is between 11.0 and 12.5.

14. The process of claim 1 in which the electroplating solution comprises a buffer.

15. The process of claim 14 in which the buffer is a phosphate buffer.

16. The process of claim 15 in which the buffer concentration is between 0.1 and 2 molar.

17. The process of claim 16 in which the buffer concentration is 1.0±0.2 molar.

18. The process of claim 1 in which the palladium-1,3-diaminopropanedichloride is synthesized by reacting palladium chloride with excess 1,3-diaminopropane to form a solution of palladium-1,3-diaminopropane ion.

19. The process of claim 18 in which said palladium-1,3-diaminopropanedichloride is formed by acidification of the solution of palladium-1,3-diaminopropane ion.

20. The process of claim 1 in which the palladium-1,3-diaminopropanedichloride is synthesized by adding chloride ion to an aqueous solution of palladium dichloride to form tetrachloropalladium(II) ion in solution and then reacting the tetrachloropalladium(II) ion with 1,3-diaminopropane to form palladium-1,3-diaminopropanedichloride.

21. The process of claim 1 in which the palladium-1,3-diaminopropanedichloride is synthesized from $Pd(NH_3)_2Cl_2$ by reacting this compound with 1,3-diaminopropane in an aqueous solution and then acidifying the solution with approximately two equivalents of acid.

22. The process of claim 1 in which the palladium-1,3-diaminopropanedichloride is synthesized from $Pd(NH_3)_2Cl_2$ by adding approximately two equivalents of 1,3-diaminopropane to an aqueous solution of $Pd(NH_3)_2Cl_2$ and the resulting solution acidified.

* * * * *